United States Patent [19]

Jacobson et al.

[11] Patent Number: 4,661,268

[45] Date of Patent: Apr. 28, 1987

[54] WRINKLE REMOVING SOLUTION AND PROCESS FOR USING SAME

[75] Inventors: Jeff A. Jacobson, Laguna Beach; Walter K. Lim, Hacienda Heights, both of Calif.

[73] Assignee: Very Incredible Products, Inc., Costa Mesa, Calif.

[21] Appl. No.: 812,121

[22] Filed: Dec. 24, 1985

[51] Int. Cl.[4] ..... D06M 11/00

[52] U.S. Cl. ..... 252/8.8; 8/115.56; 252/8.9

[58] Field of Search ..... 252/8.8, 8.9; 8/115.51, 8/115.56, 188

[56] References Cited

U.S. PATENT DOCUMENTS

| | | | |
|---|---|---|---|
| 3,140,198 | 7/1964 | Dawson et al. | 428/391 |
| 3,674,688 | 7/1972 | Schwartz et al. | 252/8.8 |
| 3,965,014 | 6/1976 | Giordano et al. | 252/8.6 |
| 4,140,709 | 2/1979 | Szur | 524/114 |
| 4,171,282 | 10/1979 | Mueller | 252/8.57 |
| 4,388,437 | 6/1983 | Ona | 524/588 |
| 4,448,810 | 5/1984 | Westall | 252/8.8 |
| 4,541,936 | 9/1985 | Ona et al. | 252/8.8 |

*Primary Examiner*—Paul Lieberman
*Assistant Examiner*—Willie J. Thompson
*Attorney, Agent, or Firm*—Bruce A. Jagger

[57] ABSTRACT

A product and process for relaxing and softening the fibers in textile fabrics. The product consisting essentially of an alcohol-aqueous admixture including a silicone-glycol copolymer surfactant and/or a fluorinated alkyl ester surfactant together with a quaternary ammonium salt surfactant. The product being preferably applied to the fabric in the form of a very fine mist and in quantities just sufficient to dampen the fabric. The dampened fabric is manipulated so as to form it to the desired configuration and it is maintained in that configuration while it drys.

9 Claims, 1 Drawing Figure

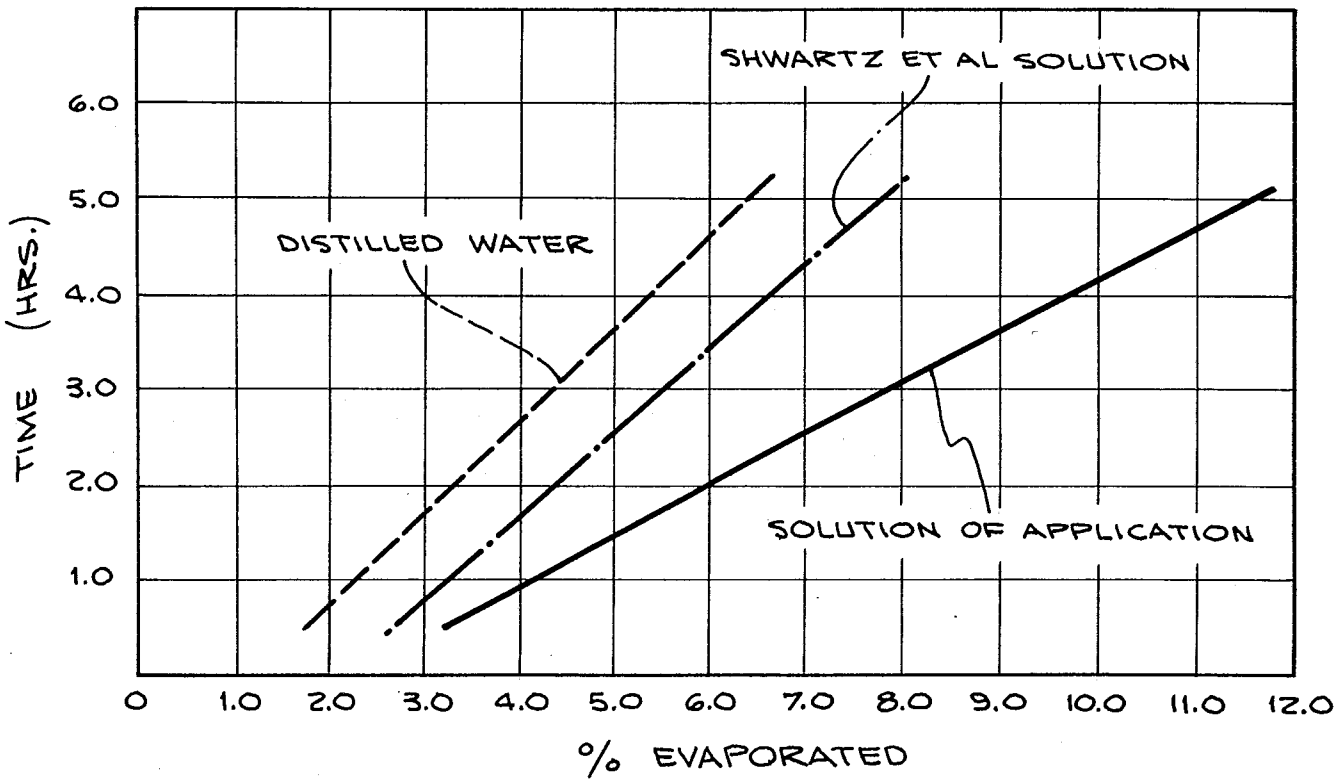
SHWARTZ ET AL SOLUTION
SOLUTION OF APPLICATION
DISTILLED WATER
TIME (HRS.)
6.0
5.0
4.0
3.0
2.0
1.0
0
1.0
2.0
3.0
4.0
5.0
6.0
7.0
8.0
9.0
10.0
11.0
12.0
% EVAPORATED

WRINKLE REMOVING SOLUTION AND PROCESS FOR USING SAME

BACKGROUND OF THE INVENTION

1. Field of the Invention

The invention relates to a fabric treating solution and a process for using same, particularly to a liquid aerosol spray which relaxes and softens the fibers in fabric and facilitates the removal of wrinkles from the fabric.

2. Description of the Prior Art

A wrinkle removing product and process are disclosed in U.S. Pat. No. 3,674,688 to Schwartz, et al. In this patent, a solution and process are disclosed for removing wrinkles and surface effect blemishes from fabrics. The solution is disclosed as an alcohol-aqueous solution containing a cationic surfactant, which surfactant is preferably a quaternary ammonium compound and is used by spraying this solution on the wrinkled fabric, manipulating the fabric to remove the wrinkles and allowing it to dry for a period of from about 15 to 60 minutes. The Schwartz, et al solution is not totally satisfactory in several respects. Because of the extended drying times which are required it has been found to be generally impractical to use this solution on a garment which is being worn at the time of application or is to be put on immediately after the time of application. The wet spot not only mars the appearance of the garment but also will take an undesired configuration if it is wrinkled before it is dry. Excessive wetting may even cause shrinkage in some fabrics. Further, the Schwartz, et al solution works in a satisfactory manner on heavy fabrics, but does not work as well on fine fabrics such as silk, satin and rayon acetate. Staining may occur with certain fabrics such as satin or rayon acetate. This appears to be due to the excessive degree of wetting which is required to relax and soften the fibers in these fabrics sufficiently to permit the removal of wrinkles therefrom. Silk fabrics treated with the Schwartz, et al solution are particularly troublesome in that they are often spotted by the application of an amount of solution which is sufficient to permit the removal of wrinkles.

Since fabrics treated according to the Schwartz, et al disclosure stay wet for an extended period of time, there is increased potential for spotting and attraction of dust. If the cloth being treated is soiled, the application of the amounts of solution required according to Schwartz, et al tends to solve the soil or dirt and distribute it throughout the fabric. If the fabric being treated is starched or sized, the large required quantities of the Schwartz, et al solution will tend to dissolve the starch or sizing and pull it into the wetted area, leaving a large spotted area on the fabric being treated.

Various silicone based materials have been proposed for use in the treatment of fabrics, including for example, dimethyl polysiloxane as an ironing aid, Giordano et al, U.S. Pat. Nos. 3,965,014, siloxane-oxyalkylenes as spreading aids, Dawson et al, 3,140,198, and organopolysiloxanes as water repellents, Ona, 4,388,437.

There is thus a need for a fiber treating solution or admixture which can be applied in small quantities well below the saturation level for the fabric while at the same time remaining effective to relax and soften the fabric. Such a solution should be quick drying and effective in very small quantities with a wide variety of fabrics so as to permit treatment of the fabric without extended delay and without staining. The solution should be effective with a wide variety of fabrics so that a user does not have to test or make inquiry to determine whether it is applicable to a particular garment. These and other advantages are provided according to the present invention.

SUMMARY OF THE INVENTION

It is an object of this invention to provide an improved fabric treating admixture and process.

It is a further object of this invention to provide an improved fabric treating admixture and process which has utility for assisting in the removal of wrinkles using a minimum of solution and which has wide application to a variety of fabrics.

It is still another object of this invention to provide an admixture and process for relaxing and softening a wide variety of fabrics so as to render them amenable to manipulation to shape the fabric to a predetermined desired configuration.

It is further an object of this invention to provide an improved wrinkle removing admixture and process for dispersing the same in very small fine droplets.

It is a further object of this invention to provide an improved composition which can be applied in an effective amount to a fabric and which will be substantially dry within less than about 5 minutes, and preferably in less than about 3 minutes.

BRIEF DESCRIPTION OF THE DRAWING

The drawing is a graph illustrating the rapid drying characteristics of the solution of the invention compared with both distilled water and a prior known solution.

DESCRIPTION OF THE PREFERRED EMBODIMENT

An admixture is described herein which will quickly soften and relax the fibers of fabrics without soaking them. The solution or admixture herein according to the present invention will dry in an extremely short period of time without the need for the application of heat. The dampened relaxed fibers enable the user to smooth out wrinkles or reshape the fabric all without staining. The solution or admixture is an aqueous alcohol solution including certain additives. As particularly contemplated in the present invention, in the exemplary embodiment, a mixture of distilled or demineralized water and a fast drying lower aliphatic alcohol is used as the carrier so that no residual dry solids remain in the fabric after treatment and drying.

The additives comprise a mixture of surfactants including a silicone-glycol copolymer surfactant and a quaternary ammonium salt. A fluorinated alkyl ester may be used in place of or in combination with the silicone-glycol copolymer. A preferred fiber relaxant solution or admixture in accordance with the teachings of the present invention is as follows:

| | |
|---|---|
| ethanol | 20 parts by weight |
| dimethyldi (hydrogenated-tallow) ammonium chloride (Arquad 2HT-75) | 0.7 parts by weight |
| silicone-glycol copolymer (Dow Corning 190 Surfactant) | 0.01 parts by weight |
| fragrance | 0.01 parts by weight |
| deionized water | 79.18 parts by weight |

A nonionic fluorinated alkyl ester (3M Fluorad) may be substituted for the silicone-glycol copolymer in this formulation in the amount of 0.01 parts by weight with equivalent results.

Preferably, the above composition is aerosolized. Conventional propellants such as, for example, admixtures of propane and isobutane are conveniently utilized as the propellant. The composition of this invention together with, for example, approximately 5 percent of a propellant is charged into an aerosol dispensing can which has a valve at one end. A nozzle which preferably has certain fine mist generating capabilities, as will be more particularly described hereinafter, is operatively combined with the valve. The composition is then ready for use.

The above formulation, packaged with a propellant in an aerosol dispenser, was applied in mist form to a mans cotton shirt collar which was too stiff to be comfortable. Just sufficient mist was applied to dampen the collar. The mist was applied with a circular motion at a range of from about 6 to 8 inches. After about 5 seconds the collar was stretched and smoothed by hand. In about 3 minutes the collar was dry enough to be worn comfortably. The treatment substantially softened and relaxed the collar. It was much more comfortable to wear and there was no indication in appearance that the composition had been used on it.

A shear silk blouse was badly wrinkled and a mist of the above described composition was applied to it in an amount just sufficient to dampen it. The mist was applied from an aerosol dispenser with a circular motion at a range of about 8 to 10 inches. After about 5 seconds the blouse was smoothed by hand to remove the wrinkles. In about 90 seconds the blouse was dry and the wrinkles were gone. There was no trace of any spot or blemish where the composition had been applied.

A medium weight pair of wool trousers was wrinkled and dampened by applying a mist of the above described composition to them while they were on the wearer. The range was about 8 inches and the mist was applied with a circular motion. After about 10 seconds the wrinkles were removed and the crease restored by manipulating the fabric by hand. In about three minutes the trousers were dry enough so that the user could resume normal activity, the wrinkles were gone, the crease was restored and no visible trace remained of the composition.

A new pair of slacks made from a blend of cotton and synthetic fibers which contained sizing was badly wrinkled. A sufficient quantity of a mist of the above composition to just dampen the fabric was applied to the slacks at a range of from about 6 to 10 inches with a circular motion and after about 10 seconds the cloth was manipulated by hand to remove the wrinkles and restore the crease. The slacks were dry enough to be worn in normal activity within about two and one half minutes. The wrinkles were gone, the crease was restored and there was no visual indication that the composition had been applied.

A badly wrinkled wool-synthetic blend suit jacket was hung on a hanger and a mist of the above composition was applied with a circular motion at a range of about 10 inches in an amount sufficient to just dampen the fabric. After about 10 seconds the wrinkles were brushed out by hand. In about three minutes the jacket was dry enough to wear in normal activity.

Particularly satisfactory results were obtained when the above described composition was applied at a distance of about 6 to 8 inches to a pair of wrinkled linen trousers. The mist was applied with a circular motion in an amount just sufficient to dampen the linen fabric and after about 10 seconds the linen was manipulated by hand to shape the fabric to the desired configuration. The fabric was maintained in this configuration for about 3 minutes after which the trousers could be worn in normal activity.

Satisfactory results are also obtained when the composition is applied to fabrics which have been treated with a water repellent.

In each of the above examples the mist was generated so that at 8 inches from the nozzle the droplets were of such a particle size that more than 40 percent of them had particle sizes of less than 5 microns and more than 99 percent of the droplets were in the range of from 2 to 90 microns.

The ethanol in the above formulation may be replaced in part or entirely with other lower aliphatic alcohols such as, for example, isopropanol, propanol, methanol, admixtures of these and the like. The quantities of lower aliphatic alcohol in the above formulation may vary from approximately 10 to 30 parts by weight; with about 20 parts being preferred. Water is added to make up the balance of the composition in quantities of from approximately 69 to 89 parts by weight. Compositions which utilize approximately the preferred quantity of alcohol exhibit a satisfactory drying rate and a reduced surface tension. Quantities of alcohol in excess of approximately 30 parts by weight are found to reduce the effectiveness of the composition in heavier fabrics, apparently because of too rapid a drying rate. Quantities of alcohol under approximately 10 parts by weight are associated with extended drying times so that water spotting may occur in light fabrics such as silk and satin and normal usage of the fabric is impaired for too long.

The surfactants disclosed herein are selected for their efficiency in reducing surface tension, wetting ability and fabric penetration at very low concentrations. This low concentration is necessary so as to not leave a visible residue or stain. Preferably, the effective concentration of the surfactants should be kept below about one part by weight in order not to stain light colored fabrics. The concentrations of the surfactants in the above formulation may be varied from approximately 0.5 to 1.5 parts by weight with satisfactory results. The quantity of the silicone-glycol copolymer fluid surfactant in the above formulation may be varied from about 0.005 to 0.1 parts by weight with the preferred quantity being from about 0.007 to 0.05 parts by weight. The quantity of fluorinated alkyl esters may be varied from about 0.001 to 0.05 parts by weight, and preferrably from about 0.005 to 0.01 parts by weight. Admixtures of the silicone-glycol copolymers and fluorinated alkyl esters may be used if desired within the above ranges. The quantity of the quaternary ammonium salt in the above formulation may be varied from about 0.4 to 1.4 parts by weight with the preferred range being from about 0.5 to 1 parts by weight.

The quaternary ammonium salt in the above formulation may be selected from a variety of such cationic surfactants which have the general structural formula

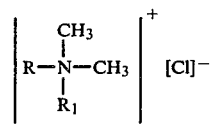

wherein R and $R_1$ are alkyl radicals having from about 14 to 20 carbon atoms.

The silicone-glycol copolymer is a low viscosity fluid (about 1500 cst at 25 degrees centigrade) which has a specific gravity of 1.035 at 25 degrees centigrade. It is combustible with the decomposition products being carbon dioxide, silicone dioxide and incompletely burned carbon products. The preferred silicone-glycol copolymer is manufactured by Dow Corning Corporation and is designated as "Dow Corning 190 Surfactant." This product is proprietary with this company.

The fluorinated alkyl ester is provided in a 50/50 by weight admixture with ethyl acetate. In this form it is a clear amber liquid and having at 25 degrees centigrade a viscosity of about 50 cp (Brookfield; Spindle #1 at 60 rpm), and a specific gravity of about 1.05. The initial boiling point is about 171 degrees Fahrenheit and the vapor pressure at 20 degrees centigrade is about 76 mm Hg. A preferred fluorinated alkyl ester is that manufactured by 3M and sold under the designation "Fluorad." This product is proprietary with 3M. This product is supplied in bases other than ethyl acetate. The water base fluorinated alkyl ester "Fluorad" which is supplied by 3M is particularly useful in the present invention.

The composition set forth hereinabove spreads and penetrates very rapidly and efficiently, particularly as compared with both ordinary distilled water and a solution having a formula according to the teachings of the Schwartz, et al patent, supra. Identical quantities of distilled water, the Schwartz et al composition and the above disclosed preferred composition were sprayed under identical conditions in 6 inch patterns onto three horizontal glass panels. All panels first appeared similar in droplet laydown pattern, but the preferred solution herein disclosed had completely wetted the panel and had sheeted out within ten to fifteen seconds, whereas the ordinary distilled water and the Schwartz, et al formula solution remained in droplet form beyond three minutes.

The advantages of the composition according to the present invention are better realized when the composition is applied in a fine mist. The mist is preferably generated so that more than about 90 and preferably more than about 95 percent of the droplets, when measured by laser about 8 inches from the nozzle, have a particle size of less than about 90 microns. Preferably, more than about 40 percent of the droplets when so measured have a particle size of less than 5 microns and at least 99 percent of the droplets are in the 2 to 90 micron size range. It is believed that the composition of the present invention promotes the formation of fine droplets, as compared with water or the Schwartz et al composition.

Although any suitable aerosol nozzel apparatus may be used to disperse the propellant solution disclosed herein a preferred valve orifice and valve specification is a Valois U1 valve manufactured and sold by Valois, having a Buna gasket, an epon coated top with an organisol bottom on the valve cup, and a lathe cut gasket with an 0.4 mm stem orifice; and a Valois 251-GP3 actuator button manufactured and sold by Valois having a 0.3 mm orifice, with three channels with small cross sections and a grill.

Pump spray apparatus may be used, if desired, although prepressurized aerosol dispensers are preferred. The full advantages of the present invention are not realized unless the composition is applied to the fabric in the form of a fine mist.

The surface tension of the sprayed droplets of the above disclosed preferred composition is less than about 28 dynes per cm, as compared to about 37 dynes per cm for the compositions disclosed in Schwartz, et al, supra. The surfactants used herein result in rapid and efficient dampening and penetration of the treated fabric, reducing the quantity of composition required to remove wrinkles.

The drawing shows a graph of evaporation rates of the three solutions discussed hereinabove, i.e., ordinary distilled water, a solution from the Schwartz, et al patent, supra, and the preferred composition disclosed hereinabove. This test was carried out under conditions where the temperature was 76 degrees Fahrenheit, the humidity was 63 percent, the air pressure was 759 mm Hg and the surface area sprayed with each liquid was 490 square inches. It can be seen that the composition disclosed herein evaporates at a rate substantially greater than both the distilled water or the Schwartz, et al solution.

What has been described are preferred embodiments in which modifications and changes may be made without departing from the spirit and scope of the accompanying claims.

What is claimed is:

1. A liquid product for relaxing fibers in textile fabrics consisting essentially of an alcohol-aqueous admixture material having from approximately 89 to 69 parts by weight water, from approximately 10 to 30 parts by weight of lower aliphatic alcohol and approximately 0.5 to 1.5 parts by weight of surfactants wherein the surfactants consist of from about 0.0001 to 0.1 parts by weight of surfactant selected from the group consisting of silicone-glycol copolymer, fluorinated alkyl ester and admixtures thereof, and from about 0.4 to 1.4 parts by weight of a quaternary ammonium salt surfactant having the structural formula

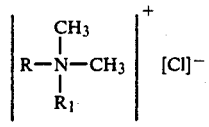

wherein R and $R_1$ are alkyl radicals having from about 14 to 20 carbon atoms, said silicone-glycol copolymer having a viscosity of approximately 1500 cst and a specific gravity of about 1.035 at 25 degrees centrigrade, and being combustible with the decomposition products being carbon dioxide, silicon dioxide and incompletely burned carbon products, said fluorinated alkyl ester when mixed in about a 50/50 by weight admixture with ethyl acetate being a clear amber liquid having at 25 degrees centrigrade a viscosity of approximately 50 cp and a specific gravity of about 1.05, said 50/50 admixture having an initial boiling point of about 171 degrees Fahrenheit and a vapor pressure of about 76 mm Hg at 20 degrees centrigrade.

2. Process for shaping a fabric to a desired configuration comprising:

preparing a fine mist in which at least about 90 percent of the droplets have a particle size of less than about 90 microns and at least 40 percent of the droplets have an average particle size of less than about 5 microns, said mist comprising an alcohol-aqueous admixture, the droplets thereon having a surface tension of less than about 28 degrees per cm, and having from approximately 89 to 69 parts by weight water, from approximately 10 to 30 parts by weight of lower aliphatic alcohol and approximately 0.5 to 1.5 parts by weight of surfactants, said mist when applied to a glass panel having the property of sheeting out within about 10 to 15 seconds, said mist when dried leaving no residual dry solids, and said mist having an evaporation rate which is substantially higher than that of water, applying said mist to said fabric in an amount just sufficient to dampen said fabric, manipulating said fabric while in said dampened state to shape said fabric to a desired configuration, and maintaining said fabric in said configuration while said fabric dries.

3. In the product of claim 1 wherein the alcohol is ethanol and the quaternary ammonium salt is dimethyl-di(hydrogenated-tallow)ammonium chloride.

4. In the product of claim 1 including approximately 20 parts by weight of alcohol, approximately 79 parts by weight of water, about 0.1 parts by weight of silicone-glycol copolymer and about 0.7 parts by weight of quaternary ammonium salt.

5. A process for assembling a system for treating fabrics for relaxing the fibers therein comprising the steps of:

preparing an aqueous alcohol surfactant containing admixture having from 89 to 69 parts by weight water, from 10 to 30 parts by weight of lower aliphatic alcohol and 0.5 to 1.5 parts by weight of surfactants wherein the surfactants consist of from about 0.001 to 0.1 parts by weight of surfactant selected from the group consisting of silicone-glycol copolymer, fluorinated alkyl ester and admixtures thereof, and from about 0.4 to 1.4 parts by weight of quaternary ammonium salt surfactant, selecting a dispensing container having an opening at one end thereof, placing a predetermined amount of said admixture in said container, selecting a spray head which is adapted to dispense said admixture in a fine mist in which at least about 90 percent of the droplets have a particle size measured eight inches from said spray head of less than about 90 microns, and assembling said spray head in cooperative relationship with said opening.

6. In the process of claim 5 including selecting a spray head wherein at least about 40 percent of the droplets have a particle size of less than about 5 microns.

7. In the process of claim 5 including selecting an aerosol container and providing an aerosol propellant in combination with said admixture.

8. In the process of claim 5 including selecting a pump dispensing container.

9. The process of claim 2 including maintaining said fabric in said configuration for no more than about 5 minutes.

* * * * *